United States Patent [19]

Gunther, Jr.

[11] Patent Number: 4,733,856

[45] Date of Patent: Mar. 29, 1988

[54] MECHANISM FOR FORMING PERSONALIZED ENVELOPES AND INSERTS

[75] Inventor: William H. Gunther, Jr., Mystic, Conn.

[73] Assignee: Gunther International, Ltd., Mystic, Conn.

[21] Appl. No.: 80,395

[22] Filed: Jul. 31, 1987

Related U.S. Application Data

[63] Continuation of Ser. No. 800,970, Nov. 22, 1985, abandoned, which is a continuation of Ser. No. 627,214, Jul. 2, 1984, abandoned.

[51] Int. Cl.[4] ..... B41F 13/54; B65B 11/48

[52] U.S. Cl. ..... 270/1.1; 270/58; 53/206; 53/266 A; 271/2; 400/624

[58] Field of Search ..... 270/1.1, 58, 12; 53/206, 266 A, 36; 271/2, 8.1, 10; 400/624, 625, 626

[56] References Cited

U.S. PATENT DOCUMENTS

| | | | |
|---|---|---|---|
| 2,865,155 | 12/1958 | Nydegger | 53/266 X |
| 4,003,183 | 1/1977 | Helm | 53/206 |
| 4,033,807 | 7/1977 | Neill et al. | 270/58 |
| 4,071,997 | 2/1978 | Gunther, Jr. et al. | 53/206 |
| 4,179,111 | 12/1979 | Gunther, Jr. et al. | 53/206 |
| 4,299,073 | 11/1981 | Golicz et al. | 53/206 |
| 4,312,169 | 1/1982 | Golicz et al. | 53/206 |
| 4,343,129 | 8/1982 | Gunther, Jr. et al. | 53/206 |
| 4,384,196 | 5/1983 | McCumber et al. | 270/58 |
| 4,464,878 | 8/1984 | Golicz et al. | 53/206 |
| 4,484,733 | 11/1984 | Loos et al. | 270/58 |

*Primary Examiner*—Eugene H. Eickholt

*Attorney, Agent, or Firm*—Stoll, Wilkie, Previto & Hoffman

[57] ABSTRACT

A mechanism in which a personalized letter assembly is printed with a name and a personalized insert assembly is printed with the same name and the two are united into an envelope and in which the insert may be either a personalized letter or a personalized card.

4 Claims, 2 Drawing Figures

MECHANISM FOR FORMING PERSONALIZED ENVELOPES AND INSERTS

This application is a continuation of pending U.S. application Ser. No. 800,970 filed Nov. 22, 1985 now abandoned which, in turn, is a continuation of Ser. No. 627,214 filed July 2, 1984 now abandoned.

DESCRIPTION

The present invention relates to a mechanism for printing a personalized letter or a personalized card and personalized envelopes and at the same time make them into a complete mailing package by folding the letters or cards and putting them onto the envelope blank which is then formed into an envelope around the letter or card which is then seealed to produce a totally personalized letter package.

Presently, it is necessary to first print the letters or cards and the envelope blanks on separate computer printers which are not in line with the letter combining machine. One method of producing such computerized personalization is to use continuous webs where the letter and envelope either follow one another laterally or are produced side by side and are slit on the combining machine and then merged.

Another method of producing the computerized personalization is to use sheet fed computer printers where the envelope blanks and the letter sheets are produced in two separate runs through the computer and then placed into feeders on the converting machinery which reads a preprinted code on the envelope and verifies that the same code is present on the letter. In this manner, it is ascertained that a particular envelope blank is being converted to a particular letter.

Such existing methods are costly and it is almost impossible to include a second personalized letter sheet with the continuous web method. With the sheet fed computer printer system, second and third sheets may be used, however, in the event that a duplication or misprint occurs, the reader stops the machine and the operator must manually intervene to reestablish the match between the envelope and the letter to resume production.

The present invention overcomes these drawbacks and has for one of its objects the provision of means for providing the exact documents as they are needed without separate operations.

Another object of the present invention is the provision of an improved mechanism in which a personalized letter assembly is printed with a name and a personalized insert assembly is printed with the same name and the two are united into an envelope.

Another object of the present invention is the provision of an improved mechanism whereby other inserts may be placed on the envelope assembly.

Another object of the present invention is the provision of an improved mechanism whereby the insert assembly may be either a personalized letter or a personalized card.

Other and further objects of the invention will be obvious upon an understanding of the illustrative embodiment about to be described, or will be indicated in the appended claims, and various advantages not referred to herein will occur to one skilled in the art upon employment of the invention in practice.

The machine is controlled by a micro-processor which sends the information to a first printer to produce a particular envelope and simultaneously pass the information to a second printer to produce a one or more page letter to the same addressee. As each item is printed, it is immediately deposited on one of two levels of the conveyor system which moves the corresponding pieces along the conveyor into a finishing machine. A second or third printer may be located at another station in order to produce second or third personalized sheets to the same person without the need of the conveyor waiting at the station for the time to produce the additional personalized sheets. This speeds the production of the unit as it works on an assembly line basis rather than an intermittent basis.

The same system may be used to produce a personalized identification card and place it into a personalized envelope blank which is then formed into a finished envelope around the personalized card. The card is fed into the computer printer where it is personalized and then placed onto a transport conveyor. Simultaneously to card personalization, an envelope blank is fed into another computer printer and personalized with the address of the card holder and deposited on the transport conveyor.

The conveyor system then moves the package to a glueing station where side glue is applied and the envelope is folded around the package.

A preferred embodiment of the invention has been chosen for purposes of illustration and description and is shown in the accompanying drawings forming a part of the specification, wherein.

Figure 1:
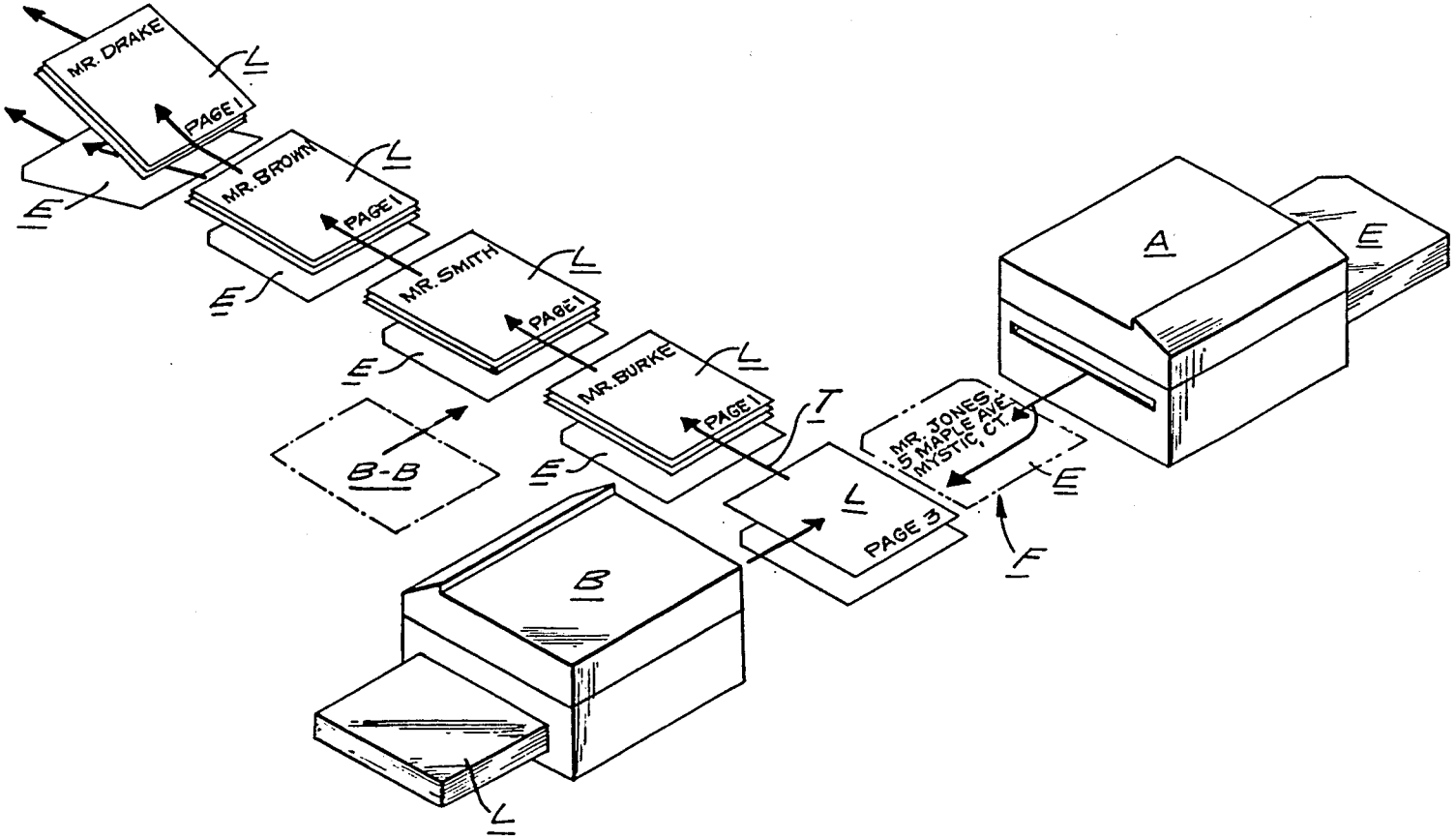
FIG. 1 is a schematic perspective view showing one embodiment of my invention.

Referring to the drawings, and more particularly to FIG. 1, the mechanism of the present invention comprises a conveyor means T, as more fully disclosed in my co-pending U.S. patent application Ser. No. 423,665, filed on Sept. 27, 1982.

A stack of insert assemblies L are fed to a printer B where they are printed and personalized with a name and are then fed to the conveyor means T. An address printer A is mounted on the opposite side of the conveyor T for printing a personalized envelope assembly E with a name which corresponds to the name on the personalized insert assembly L. Each envelope assembly E is fed to the printer A and each is then placed on a station F which inverts each envelope assembly E upside-down so that the personalized insert assembly L is placed on the inside surface of the envelope assembly E. Additional pages of the insert assembly L, or additional insert assemblies, may be placed on the envelope assembly E at other stations along conveyor T as shown in broken lines as BB in FIG. 1. Each letter assembly L and envelope assembly E are then fed to a folding and sealing area (not shown) which may be substantially identical to the structure shown in my said co-pending U.S. application Ser. No. 423,665. The envelope assembly is wrapped around the insert assembly to form the finished letter assembly.

Figure 2:
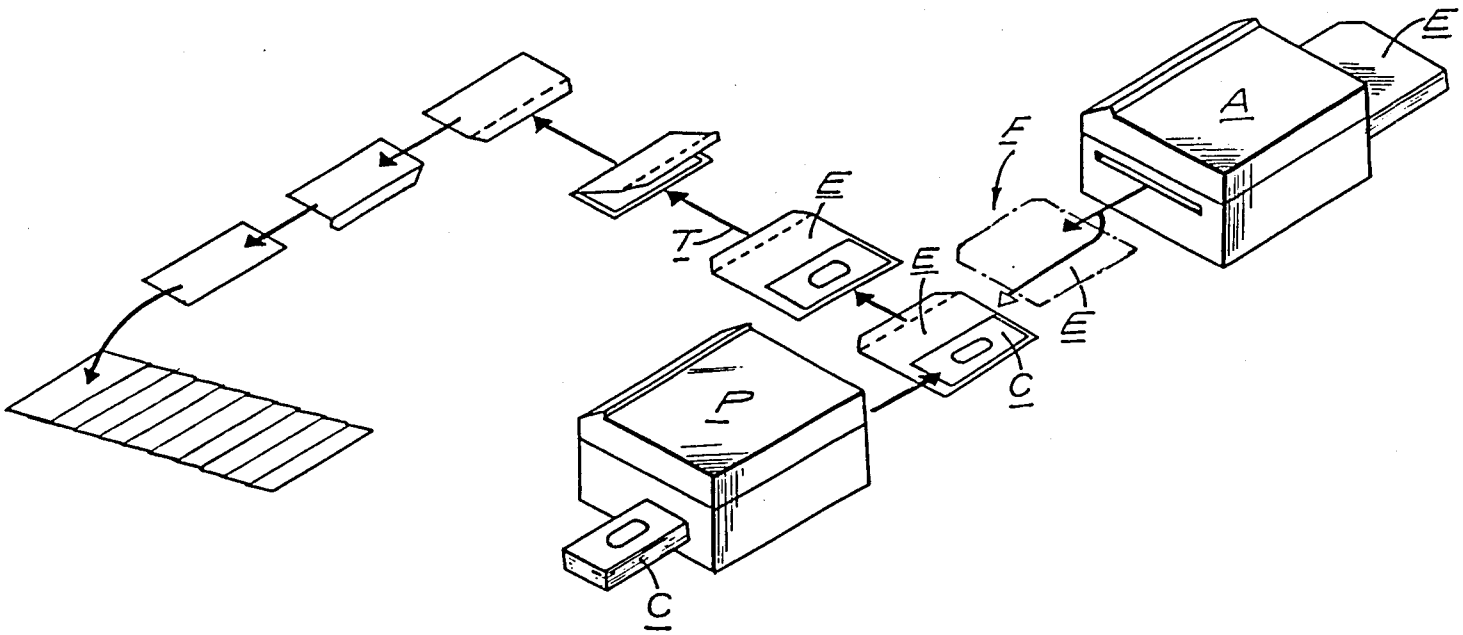
FIG. 2 is a schematic perspective view of another embodiment of my invention.

FIG. 2 is directed to another embodiment of the present invention showing the use of this concept in connection with a personalized card assembly C. The printer A is similar to the printer A shown in FIG. 1 and will print a personalized envelope assembly E which will then be fed and inverted at station F so that the address is face down.

A card printer P is mounted on the opposite sides of the conveyor T and has a name printed on each card C which corresponds to the name on the envelope assembly E. The card C is placed on top of the envelope E which is then moved by the conveyor T to the folding mechanism (not shown) which is more fully disclosed in my co-pending U.S. application Ser. No. 423,665.

It will thus be seen that the present invention provides an improved mechanism in which a personalized letter assembly is printed with a name and a personalized insert assembly is printed with the same name and the two are united into an envelope, in which other inserts may be placed on the envelope assembly and in which the insert assembly may be either a personalized letter or a personalized card.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for forming a personalized letter assembly having a personalized insert assembly and a personalized envelope assembly comprising conveyor means, first means for printing a blank envelope assembly with a name, second means for printing a blank insert assembly with the same name, means for feeding a blank insert assembly and a blank envelope assembly separately to said printing means, means for directing each printing means to print the same name on the letter and the envelope assemblies, said printing means operatively associated with said directing means, each of said printing means mounted adjacent said conveyor means, a stack of said blank insert assemblies and a stack of said blank envelope assemblies adjacent each of said printing means, means operatively associated with said stacks for feeding the blank insert assemblies one-by-one and for feeding the blank envelope assemblies one-by-one separately from their respective stacks to their respective printing means, means for activating said directing means to direct each printing means to print the same name on the insert and envelope assemblies, means adjacent said conveyor means for placing each envelope assembly on said conveyor means, means operatively associated with said placing means for inverting each of said printed envelope assemblies before being placed on said conveyor means so that the printed name thereon faces said conveyor means, means operatively associated with said conveyor means for placing each insert assembly over said envelope assembly, and means operatively associated with said conveyor means for folding said envelope assembly around said insert assembly to form said letter assembly.

2. A mechanism as claimed in claim 1 wherein said printing means for said envelope assembly is on one side of the conveyor means and the printing means for the insert assembly is on the other side of the conveyor means.

3. A mechanism as claimed in claim 2 wherein said insert assembly is a card.

4. A mechanism as claimed in claim 2 wherein additional insert printing assemblies are provided along the said conveyor means to print additional insert assemblies and deposit them on said envelope assembly.

* * * * *